US006513350B1

(12) United States Patent
Hurd et al.

(10) Patent No.: US 6,513,350 B1
(45) Date of Patent: Feb. 4, 2003

(54) COMPUTER PHYSICAL SECURITY DEVICE

(75) Inventors: Jonathan Hurd, Mill Valley, CA (US); Greg Zeren, Sunnyvale, CA (US); Lambert Kuo, Tainan (TW)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/665,886

(22) Filed: Sep. 20, 2000

(51) Int. Cl.[7] ..... E05B 37/02; E05B 73/00
(52) U.S. Cl. ..... 70/58; 70/23; 70/30
(58) Field of Search ..... 70/14, 18, 30, 70/49, 34, 58, 23, 424

(56) References Cited

U.S. PATENT DOCUMENTS 1,050,276 A * 1/1913 Johnson
4,057,984 A * 11/1977 Avaiusini ..... 70/58
5,119,649 A * 6/1992 Spence ..... 70/14
5,327,752 A * 7/1994 Myers et al. ..... 70/58
5,381,685 A * 1/1995 Carl et al. ..... 70/58
5,787,739 A * 8/1998 Derman ..... 70/14 X
5,913,907 A * 6/1999 Lee ..... 70/14 X
6,006,557 A * 12/1999 Carl et al. ..... 70/14 X
6,038,891 A * 3/2000 Zeren et al. ..... 70/14 X
6,058,744 A * 5/2000 Ling ..... 70/28
6,112,561 A * 9/2000 Carl ..... 70/14 X
6,170,304 B1 * 1/2001 Ohta ..... 70/14
6,205,824 B1 * 3/2001 Miuo ..... 70/14 X
6,227,017 B1 * 5/2001 Igelmund ..... 70/14 X
6,244,082 B1 * 6/2001 Avganim ..... 70/14 X

* cited by examiner

*Primary Examiner*—Lloyd A. Gall
(74) *Attorney, Agent, or Firm*—Townsend & Townsend & Crew LLP

(57) ABSTRACT

A physical security system with a combination lock for connecting specially designed security slots in portable devices, including portable electronic devices such as laptop computers, personal data assistants.

16 Claims, 3 Drawing Sheets

COMPUTER PHYSICAL SECURITY DEVICE

BACKGROUND OF THE INVENTION

The present invention relates generally to devices for inhibiting the theft of relatively small but expensive pieces of portable equipment. More specifically, the invention relates to a lock interface for a specially designed slot having predetermined dimensions. Most specifically, the invention relates to a physical security device including a combination lock for connecting to a security slot with dimensions of about 3 mm by about 7 mm.

Computers and other electronic devices have evolved rapidly from large, expensive machines to relatively small portable devices that are increasingly becoming commonplace. The proliferation of laptop computers and personal data assistants (PDAs); with the concomitant usage increases, has resulted in a tremendous investment of resources (time and money) in these portable devices. Further, the ease by which users are able to transport these portable devices and the increasing computing/processing/storage power incorporated into these portable devices results in a tremendous investment in the portable device itself, and the data and applications stored within the device. The problems relating to theft of these portable devices increases directly as the value (data and replacement costs) of the portable device increases.

A variety of devices have been developed that inhibit the theft of portable devices. An early type of physical security system inhibited the theft of desktop computer systems. These systems include several components, typically including the housing having the CPU, disk drives and various interface elements, a monitor, keyboard, trackball and a printer. One or more cables would be used to localize the components to a relatively immovable object, such as a desk. One difficulty associated with these systems was provision of an effective and efficient mechanism for attaching the cable itself to the components.

Kensington Technology Group (Kensington), a division of ACCO Brands, Inc. and assignee of this application, developed an early physical security system for use with early models of APPLE® computers. These computers would be designed with a special retaining slot, into which a special bracket would be unremovably inserted and retained. A cable could be attached to this bracket and to a desk, thereby inhibiting theft of the computer. This solution is not an optimum one for portable devices, in which it would be preferable to have a removable solution that did not result in addition of a bracket that extended from a wall of the portable device. Such a solution is further undesirable in that this solution used a specially reinforced slot that was relatively large. The portable devices have relatively thin elastomer walls that often have little available internal space.

Kensington worked with portable electronic device manufactures (e.g., laptop and PDA manufacturers) for incorporation of a Kensington developed standard security slot into a wall of their devices. This standard security slot is generally rectangular, having dimensions of about 3 mm×7 mm. Kensington has applied for, and obtained numerous patents relating to physical security devices that cooperate with this special security slot to inhibit theft of the portable device. U.S. Pat. No. 5,327,752 for "Computer Equipment Lock"; U.S. Pat. No. 5,381,685 for "Computer Physical Security Device"; U.S. Pat. No. 6,006,557 for "Computer Physical Security Device"; U.S. Pat. No. 6,112,561 for "Security Device for a Portable Computer"; U.S. Pat. No. 5,787,739 for "Security Hole Fastening Device"; U.S. Pat. No. 6,038,891 for "Security Hole Fastening Device" hereby expressly incorporated by reference for all purposes, teach various preferred embodiments for acceptable physical security systems, devices and methods. Among these preferred embodiments are keyed locking solutions. In some applications, and for some users, it is preferable to provide a keyless locking system that offers advantages similar to the keyed solutions.

SUMMARY OF THE INVENTION

The present invention provides a simple yet efficient solution to the prior art problem of inhibiting theft of portable electronic devices. Specifically, the present invention discloses lock interfaces for a specially designed slot having predetermined dimensions and methods of providing a locking interface to a specially designed slot without use of a key separate from the lock interface.

According to a preferred embodiment of the invention, it defines physical security system, including a portable device having a wall defining a security slot; a housing having a top end, a bottom end, and a sidewall therebetween, the bottom end including a slot engagement member provided with a locking member insertable within the security slot and a retaining member disposed between the locking member and the housing for engaging an exterior portion of the wall proximate the security slot when the locking member enters into the security slot to facilitate movement of the engagement member into the retracted position by application of force to the housing and wherein the locking member extends into the security slot, the slot engagement member being moveable, relative to the housing, between an extended position and a retracted position, wherein the engagement member is biased towards the extended position and is rotationally fixed relative to the housing and wherein the locking member is moveable, when the engagement member is in the extended position, between an unlocked position and a locked position by movement of the engagement member with the locking member retained within the portable device when in the locked position and with the locking member disengageable from within the portable device when in the unlocked position; a pin, extending from the housing, for cooperating with the security slot when the slot engagement member is in the retracted position and the locking member is in the locked position, assisting opposition of movement of the locking member to the unlocked position; and a retention mechanism for maintaining the engagement member in the retracted position; and a cable attachment mechanism, coupled to the housing, for securing a cable to the housing wherein the cable is attachable to an object other than to the portable object.

Another preferred embodiment of the present invention includes a method for securing a portable object to a localizer object. This method includes the steps of: aligning a locking member of an engagement member extending from a housing with a security slot defined in a wall of the portable object wherein the engagement member has an extended position and a retracted position relative to the housing and the engagement member is biased in the extended position; inserting the locking member into the security slot; misaligning the locking member from the security slot while the locking member is within the portable object; transitioning the engagement member to the retracted position by engaging a portion of the wall proximate to the security slot with a retaining member coupled to the engagement member and moving the housing towards the portion; cooperating a pin with the engagement member and the security slot when the engagement member has been transitioned to the retracted position such that realignment of the locking member with the security slot is inhibited while the engagement member is in the retracted position; and localizing the portable object to the localizer object by coupling a localizer to the localizer object.

Further understanding of the nature and advantages of the invention may be realized by reference to the remaining portions of the Specification and Drawings. In the drawings, similarly numbered items represent the same or functionally equivalent structures.

DESCRIPTION OF THE SPECIFIC EMBODIMENTS

Figure 1:
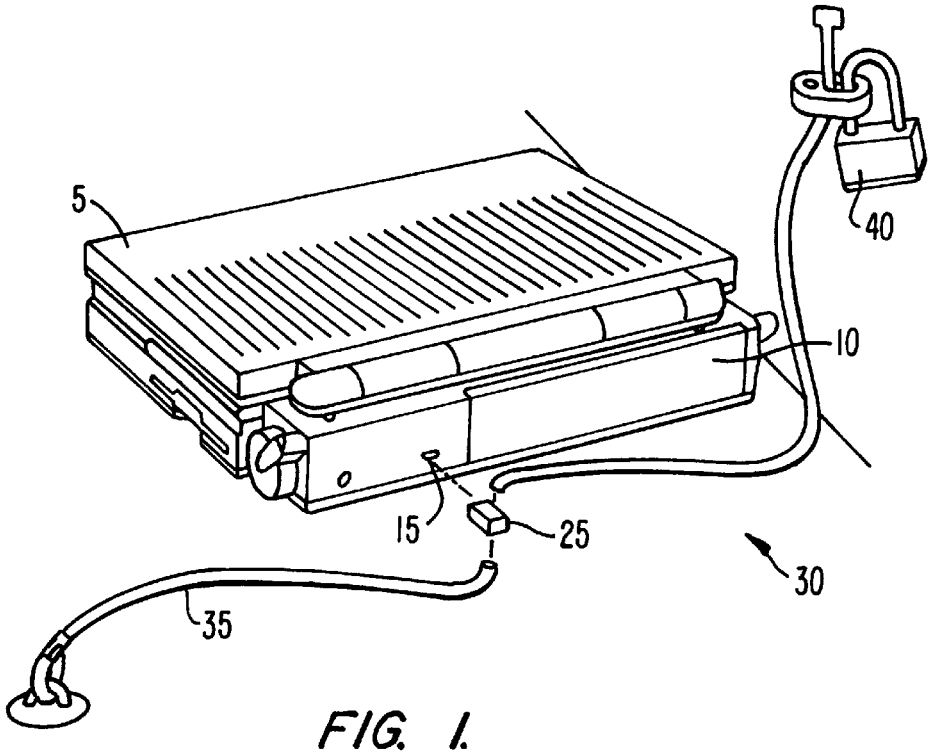
FIG. 1 illustrates a typical use of an embodiment of the present invention.

FIG. 1 illustrates a typical use of an embodiment of the present invention. A portable computer 5 has a wall 10 provided with a slot 15. Wall 10 includes an inner surface 20. A lock interface 25 is engageable with wall 10 through slot 15. A locking mechanism 30, according to the preferred embodiment, includes a cable 35 and a lock 40. In operation, a user inserts lock interface 25 into slot 15 and engages lock interface 25 with inner surface 20. Once engaged, a user can attach lock interface 25 to a stationary object with cable 35 and lock 40.

Figure 2:
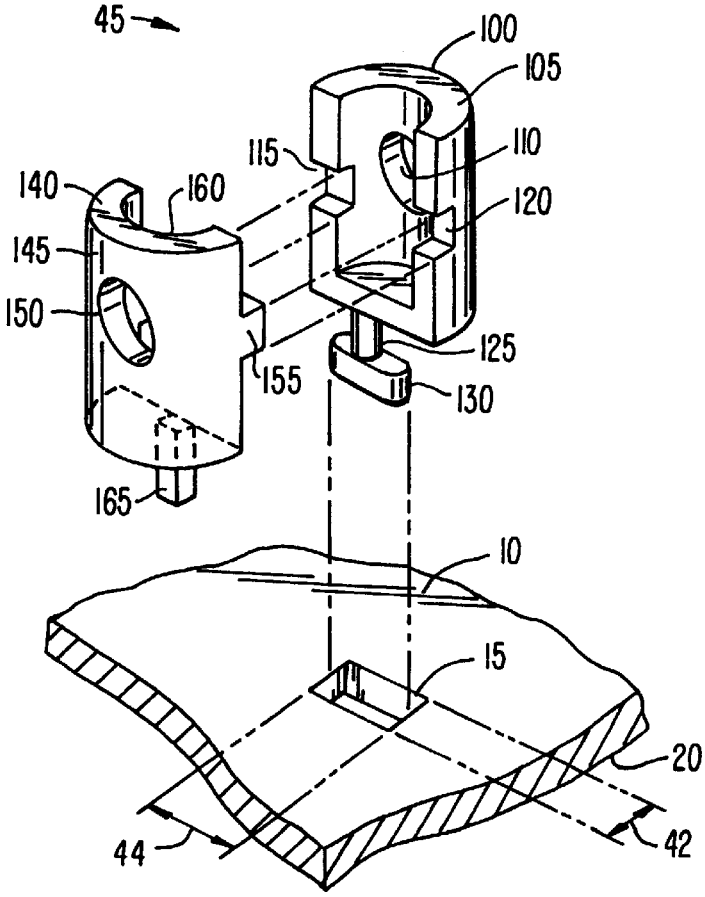
FIG. 2 is a perspective view of an embodiment of the present invention.

FIG. 2 is a perspective view of an embodiment of the present invention including a lock interface 45. Slot 15 has a small dimension 42 and a large dimension 44. Lock interface 45 includes an anchor spindle 100 having a body portion 105. Body portion 105 includes an aperture 110, two engagement members (engagement member 115 and engagement member 120), a neck portion 125, and a head portion 130. Neck portion 125 has a length exceeding a thickness of wall 10, enabling head portion 130 to be fully inserted into slot 15. In the preferred embodiment, head portion 130 preferably has a shape similar to slot 15. Lock interface 45 also includes a locking spindle 140 having a body portion 145. Body portion 145 includes an aperture 150, two engagement members (engagement member 155 and engagement member 160), and a locking pin 165.

Figure 3:
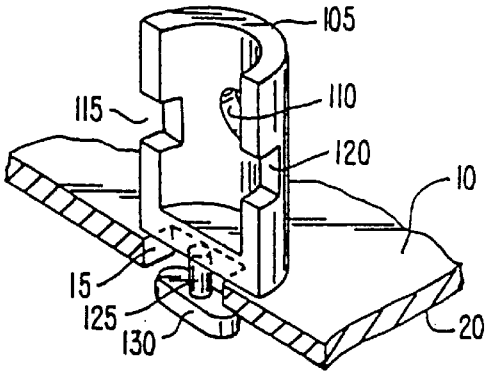
FIG. 3 is a perspective view illustrating a head portion of an embodiment of the present invention aligned inserted into a security slot.
Figure 4:
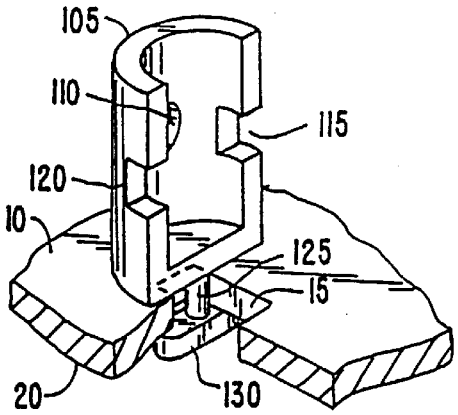
FIG. 4 is another perspective view illustrating a head portion of an embodiment of the present invention inserted and misaligned with slot 15.
Figure 5:
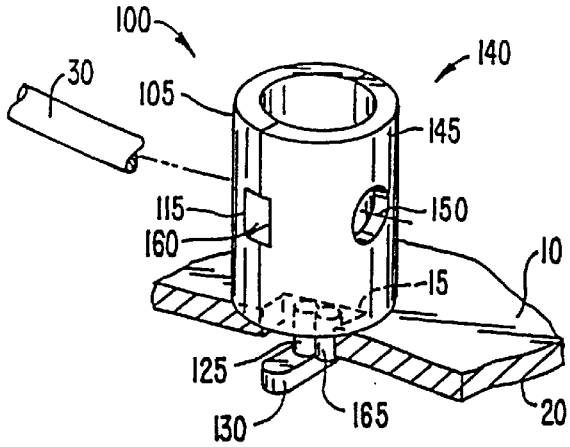
FIG. 5 is a perspective view illustrating head portion 130 of an embodiment of the present invention engaging inner surface 20 and locking pin 165 inserted into slot 15.

In operation, a user aligns head portion 130 with slot 15 and inserts head portion 130 into slot 15. FIG. 3 is a perspective view illustrating head portion 130 of an embodiment of the present invention aligned and inserted into slot 15. FIG. 4 is another perspective view illustrating head portion 130 of an embodiment of the present invention inserted and misaligned with slot 15. Mis-aligning head portion 130 with slot 15 engages head portion 130 with inner surface 20 of wall 10, thereby inhibiting removal of lock interface 45 from computer 5. Subsequent insertion of locking pin 165 into slot 15 inhibits re-alignment of head portion 130 with slot 15. FIG. 5 is a perspective view illustrating head portion 130 of an embodiment of the present invention engaging inner surface 20 and locking pin 165 inserted into slot 15. Engaging engagement member 115 with engagement member 160, and engagement member 120 with engagement member 155 (not shown) engages anchor spindle 100 with locking spindle 160. In the preferred embodiment, the size of neck portion 125 together with locking pin 165 exceeds small dimension 42 of slot 15, inhibiting rotation of locking spindle 140 and anchor spindle 100 together as a unit into slot 15, thereby inhibiting realignment of head portion 130 with slot 15. Inserting a locking mechanism 30 through aperture 110 and aperture 150 maintains the engagement of anchor spindle 100 with locking spindle 140, and can be used to lock the computer 5 to a stationary object.

Figure 6:
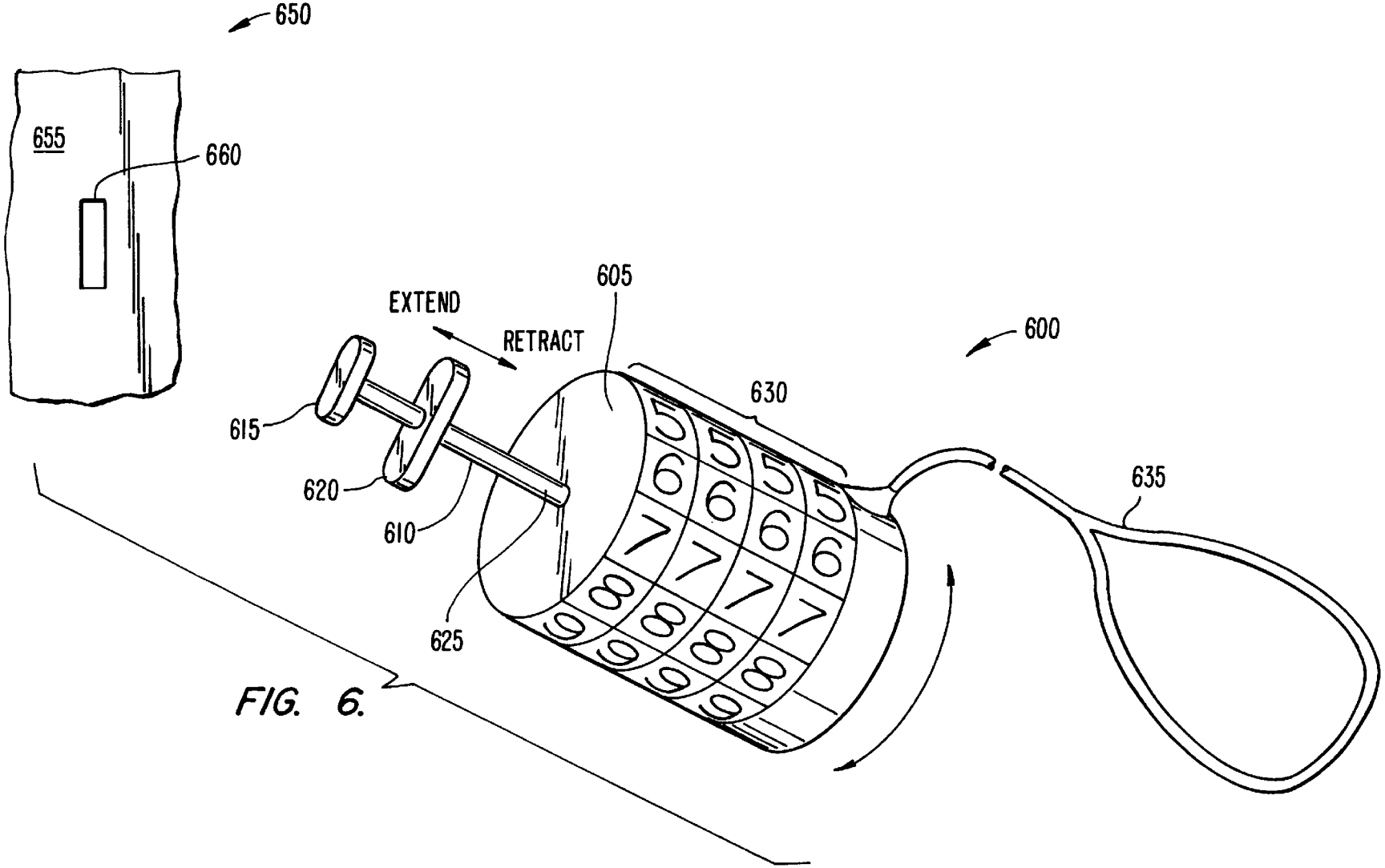
FIG. 6 is a preferred physical security interface embodiment.

FIG. 6 is an alternate interface embodiment to those embodiments disclosed in the incorporated patent references. Locking system 600 includes a housing 605 and a slot engagement member 610 having a locking member 615 and a retaining member 620. Housing 605 includes a top wall, a bottom wall, and a sidewall therebetween. Engagement member 610 is coupled to housing 605 such that it moves between an extended and a retracted position. Housing 605 is biased in the extended position in the preferred embodiment. Two pins 625 extend from housing 605 and are located on opposing sides of a shaft of engagement member 610. Some embodiments of the present invention may include fewer or more pins 625. Housing 605 includes a combination lock mechanism 630 for interacting with engagement member 610 and retaining it in the retracted position until a proper combination code Clean Version of Pending Specification (Description of the Specific Embodiments) is entered in conventional fashion. Many well-known combination locking systems may be used as retaining mechanisms for holding slot engagement member 610 in its retracted position. In a preferred embodiment, a localizer 635, such as for example a cable or an inventory control-type device, is coupled to housing 605.

Locking system 600 interfaces to a portable device 650 having a wall 655 defining a security slot 660. Security slot 660 is typically a slot conforming to the security slot standard developed and promulgated by Kensington Technology Group, a division of the assignee of the present application. The preferred embodiment of security slot 660 is 3 mm×7 mm.

Locking member 615 is complementary to security slot 660, which in the preferred embodiment means that it includes an orientation which permits insertion into and removal from security slot 660. In the most preferred embodiment, peripheral dimensions of locking member 615 match the security slot dimensions.

In operation, locking member 615 of slot engagement member 610 is aligned with security slot 660, permitting locking member 615 to pass through wall 655 and enter into an interior portion of portable device 650. Entry of locking member 615 into security slot 660 is possible, in the preferred embodiment, to a predetermined depth before retaining member 620 engages a portion of wall 655 proximate security slot 660. Slot engagement member 610 is moved into misalignment (e.g., by rotation) before or after engagement of retaining member 620 and wall 655, which in the preferred embodiment is achieved by rotating housing 605. In other embodiments, other well-known methods of misalignment may be used.

Once retaining member 620 engages wall 655, further movement of housing 605 towards security slot 660 moves engagement member 610 towards the retracted position. As engagement member 610 moves to the retracted position, pins 625 cooperate with engagement member 610, security slot 660, and housing 605. In the preferred embodiment, this cooperation is achieved by rigidly extending pins 625 from housing 605, and retraction of engagement member 610 relative to housing 605 results in pins 625 entering into security slot 660 proximate engagement member 610. Depending upon a preferred implementation, pins 625 may extend just into security slot 660, or extend through security slot 660 into the portable device and beyond locking member 615.

Once engagement member 610 retracts and pins 625 cooperate with security slot 660, retaining mechanism 630 maintains engagement member 610 in the retracted position. As long as engagement member 610 is in the retracted position with locking member 615 within and misaligned with security slot 660 while pins 625 are cooperating with security slot 660 as described above, housing 605 strongly resists removal from the portable device. Association of localizer 635 to a localizing object other than the portable device, such as by attaching a cable to the localizing object or by placement of the inventory control tag interface near an exit, constrains movement of the portable object to within a preestablished distance of the localizer object.

Operation of retaining mechanism 630 to release engagement member 610 and permit it to move to the extended position (e.g., by entry of the proper combination) releases pins 625 from cooperation with security slot 660 permitting locking member 615 to be realigned with and removed from security slot 660. Without attachment of locking system 600 to the portable device, the portable device may be moved away from the localizer object.

In the foregoing specification, the invention has been described with reference to a specific exemplary embodiments thereof. It will, however, be evident that various modifications and changes may be made thereunto without departing from the broader spirit and scope of the invention as set forth in the claims.

Many changes or modifications are readily envisioned, for example, changing the shape of the slot and the shape of the head portion, adding catches to the engagement members, and changing the shape of the flanges among other changes. The specification and drawings are, accordingly, to be regarded in an illustrative rather than in a restrictive sense.

What is claimed is:

1. A locking apparatus, comprising:

a housing having a top end, a bottom end, and a sidewall between said top end and said bottom end, said bottom end including a slot engagement member provided with a locking member insertable within a security slot provided in a wall of a portable device wherein said locking member extends into said security slot, said slot engagement member being moveable, relative to said housing, between an extended position and a retracted position, wherein said engagement member is biased towards said extended position and is rotationally fixed relative to said housing and wherein said locking member is moveable, when said engagement member is in said extended position, between an unlocked position and a locked position by movement of said engagement member with said locking member retained within said portable device when in said locked position and with said locking member disengageable from within said portable device when in said unlocked position;

a pin, extending from said housing, cooperating with said security slot when said slot engagement member is in said retracted position and said locking member is in said locked position to thereby inhibit movement of said locking member to said unlocked position, wherein said pin is outside said security slot when said slot engagement member begins to retract; and a retention mechanism for maintaining said engagement member in said retracted position.

2. The locking apparatus of claim 1 wherein said engagement member includes a retaining member disposed between said locking member and said housing for engaging an exterior portion of said wall proximate the security slot when said locking member enters into said security slot to facilitate movement of said engagement member into said retracted position by application of force to said housing.

3. The locking apparatus of claim 1 wherein said retention mechanism includes a combination lock.

4. The locking apparatus of claim 1 further comprising a cable attachment mechanism coupled to said housing, for securing a cable to said housing.

5. A physical security system for constraining movement of a portable object within a limited distance of a first object, wherein the portable object includes a wall defining a security slot, comprising:

a housing having a top end, a bottom end, and a sidewall between said top end and said bottom end, said bottom end including a slot engagement member provided with a locking member insertable within a security slot provided in a wall of a portable device and a retaining member disposed between said locking member and said housing for engaging an exterior portion of the wall proximate the security slot when said locking member enters into the security slot to facilitate movement of the engagement member into a retracted position by application of force to said housing and wherein said locking member extends into the security slot, said slot engagement member being moveable, relative to said housing, between an extended position and said retracted position, wherein said engagement member is biased towards said extended position and is rotationally fixed relative to said housing and wherein said locking member is moveable, when said engagement member is in said extended position, between an unlocked position and a locked position by movement of said engagement member with said locking member retained within the portable device when in said locked position and with said locking member disengageable from within the portable device when in said unlocked position;

a pin, extending from said housing, for cooperating with the security slot when said slot engagement member is in said retracted position and said locking member is in said locked position to thereby inhibit movement of said locking member to said unlocked position;

a retention mechanism for maintaining said engagement member in said retracted position; and a cable attachment mechanism, coupled to said housing, for securing a cable to said housing wherein said cable is attachable to the first object.

6. A physical security system according to claim 5, wherein said retaining member is disposed on said slot engagement member and external to said housing.

7. A physical security system, comprising:

a portable device having a wall defining a security slot;

a housing having a top end, a bottom end, and a sidewall between said top end and said bottom end, said bottom end including a slot engagement member provided with a locking member insertable within said security slot and a retaining member disposed between said locking member and said housing for engaging an exterior portion of said wall proximate said security slot when said locking member enters into said security slot to facilitate movement of the engagement member into a retracted position by application of force to said housing and wherein said locking member extends into said security slot, said slot engagement member being moveable, relative to said housing, between an extended position and said retracted position, wherein said engagement member is biased towards said extended position and is rotationally fixed relative to said housing and wherein said locking member is moveable, when said engagement member is in said extended position, between an unlocked position and a locked position by movement of said engagement member with said locking member retained within said portable device when in said locked position and with said locking member disengageable from within said portable device when in said unlocked position;

a pin, extending from said housing, for cooperating with said security slot when said slot engagement member is in said retracted position and said locking member is in said locked position to thereby inhibit movement of said locking member to said unlocked position;

a retention mechanism for maintaining said engagement member in said retracted position; and a cable attachment mechanism, coupled to said housing, for securing a cable to said housing wherein said cable is attachable to an object other than to said portable device.

8. A physical security system according to claim 7, wherein said retaining member is disposed on said slot engagement member and external to said housing.

9. A method for securing a portable object to a localizer object, comprising the steps of:

aligning a locking member of an engagement member extending from a housing with a security slot defined in a wall of the portable object wherein said engagement member has an extended position and a retracted position relative to said housing and said engagement member is biased in said extended position;

inserting said locking member into said security slot;

misaligning said locking member from said security slot while said locking member is within the portable object;

transitioning said engagement member to said retracted position by engaging a portion of said wall proximate to said security slot with a retaining member coupled to said engagement member and moving said housing towards said portion;

cooperating a pin with said engagement member and said security slot when said engagement member has been transitioned to said retracted position such that realignment of said locking member with said security slot is inhibited while said engagement member is in said retracted position; and localizing the portable object to the localizer object by coupling a cable extending from said housing to the localizer object.

10. A method according to claim 9, wherein said retaining member is disposed on said slot engagement member and external to said housing.

11. A method according to claim 9, wherein said pin is outside said security slot when said slot engagement member begins to retract.

12. A method for securing a portable object to a localizer object, comprising the steps of:

aligning a locking member of an engagement member extending from a housing with a security slot defined in a wall of the portable object wherein said engagement member has an extended position and a retracted position relative to said housing and said engagement member is biased in said extended position;

inserting said locking member into said security slot;

misaligning said locking member from said security slot while said locking member is within the portable object;

transitioning said engagement member to said retracted position by engaging a portion of said wall proximate to said security slot with a retaining member coupled to said engagement member and moving said housing towards said portion;

cooperating a pin with said engagement member and said security slot when said engagement member has been transitioned to said retracted position such that realignment of said locking member with said security slot is inhibited while said engagement member is in said retracted position; and localizing the portable object to the localizer object by coupling a cable extending from said housing to the localizer object maintaining said engagement member in said retracted position; and securing said cable to said housing wherein said cable is attachable to an object other than to the portable object.

13. A method according to claim 12, wherein said retaining member is disposed on said slot engagement member and external to said housing.

14. A method according to claim 12, wherein said pin is outside said security slot when said slot engagement member begins to retract.

15. A physical security system for constraining movement of a portable object within a limited distance of a first object, wherein the portable object includes a wall defining a security slot, comprising:

a housing having a top end, a bottom end, and a sidewall between said top end and said bottom end, said bottom end including a slot engagement member provided with a locking member insertable within a security slot provided in a wall of a portable device and a retaining member disposed between said locking member and said housing for engaging an exterior portion of said wall proximate said security slot when said locking member enters into said security slot to facilitate movement of said engagement member into a retracted position by application of force to said housing and wherein said locking member extends into said security slot, said slot engagement member being moveable, relative to said housing, between an extended position and said retracted position, wherein said engagement member is biased towards said extended position and is rotationally fixed relative to said housing and wherein said locking member is moveable, when said engagement member is in said extended position, between an unlocked position and a locked position by movement of said engagement member with said locking member retained within the portable device when in said locked position and with said locking member disengageable from within the portable device when in said unlocked position;

a pin, extending from said housing, for cooperating with said security slot when said slot engagement member is in said retracted position and said locking member is in said locked position, assisting opposition of movement of said locking member to said unlocked position;

a retention mechanism for maintaining said engagement member in said retracted position; and a cable attachment mechanism, coupled to said housing, for securing a cable to said housing wherein said cable is attachable to the first object.

16. A locking apparatus, comprising:

a housing having a top end, a bottom end, and a sidewall between said top end and said bottom end, said bottom end including a slot engagement member provided with a locking member insertable within a security slot provided in a wall of a portable device wherein said locking member extends into said security slot, said slot engagement member being moveable, relative to said housing, between an extended position and a retracted position, wherein said engagement member is biased towards said extended position and is rotationally fixed relative to said housing and wherein said locking member is moveable, when said engagement member is in said extended position, between an unlocked position and a locked position by movement of said engagement member with said locking member retained within said portable device when in said locked position and with said locking member disengageable from within said portable device when in said unlocked position;

means for cooperating with said security slot when said slot engagement member is in said retracted position and said locking member is in said locked position to thereby inhibit movement of said locking member to said unlocked position, wherein said means extends from said housing and is outside said security slot when said slot engagement member begins to retract; and means for maintaining said engagement member in said retracted position.

* * * * *